United States Patent [19]

Kellogg et al.

[11] Patent Number: 5,019,549

[45] Date of Patent: May 28, 1991

[54] DONOR ELEMENT FOR THERMAL IMAGING CONTAINING INFRA-RED ABSORBING SQUARYLIUM COMPOUND

[76] Inventors: Reid E. Kellogg, 808 Princeton Road, Wilmington, Del. 19807; Evan D. Laganis, 204 West Crest Road, Wilmington, Del. 19803; Sheau-Hwa Ma, 29 Constitution Drive, Chaddsford, Pa. 19317

[21] Appl. No.: 603,278

[22] Filed: Oct. 25, 1990

[51] Int. Cl.[5] ..... B41M 5/035; B41M 5/26

[52] U.S. Cl. ..... 503/227; 8/471; 428/195; 428/913; 428/914; 430/200; 430/201; 430/945

[58] Field of Search ..... 8/471; 428/195, 913, 428/914; 430/200, 201, 945; 503/227

[56] References Cited

U.S. PATENT DOCUMENTS 4,942,141 7/1990 DeBoer et al. ..... 503/227

*Primary Examiner*—Bruce H. Hess

[57] ABSTRACT

These is disclosed donor elements for laser-induced thermal imaging processes containing infra-red absorbing squarylium dyes of the following structure:

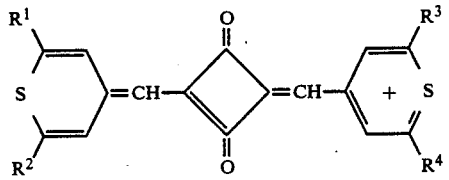

wherein $R^1$, $R^2$, $R^3$, and $R^4$ are each independently alkyl groups of from one to eight carbon atoms.

28 Claims, No Drawings

DONOR ELEMENT FOR THERMAL IMAGING CONTAINING INFRA-RED ABSORBING SQUARYLIUM COMPOUND

FIELD OF THE INVENTION

This invention relates to thermal imaging. More particularly this invention relates to donor elements for laser-induced thermal imaging processes in which the donor element contains certain infra-red absorbing squarylium compounds.

BACKGROUND OF THE INVENTION

Thermal imaging processes are well-known. In these processes a donor element comprising a colorant is heated, by, for example, a thermal head or an infra-red laser, causing the colorant to be transferred to a receptor sheet. Depending on the process, the colorant may be a dye or pigment or a mixture of dyes and/or pigments. Imagewise heating of the donor element reproduces the corresponding image on the receptor sheet. Transfer in register to the same receptor sheet from several differently colored donor elements produces a multicolored image. Different single colored donor elements or a multicolor donor element carrying different colors in different regions which can be brought into position in turn can be used for transfer.

When an infra-red laser is used for thermal transfer, only a single, small, selected area is heated at one time. Since only a small region of colorant is heated and transferred, the image can be built up pixel by pixel. Computer control of such processes allows multicolor images of high definition to be produced at high speed. This process is disclosed in Baldock, UK Patent 2,083,726.

In the laser-induced thermal dye transfer process, the donor element comprises a heat transferable dye, sometimes called a thermal transfer dye, usually in a formulation with a binder, supported on a substrate. The dye donor element is contacted with a receptor sheet, and the surface of the substrate irradiated with an infra-red laser to transfer the dye to the receptor sheet. For the heat transferable dye to be directly heated by the laser, a dye which strongly absorbs the wavelength of the exciting laser is required. This need to match the infra-red absorption of the dye to the emission of the laser greatly restricts the number of dyes which can be used in the laser-induced thermal transfer process.

As an alternative, the dye may be heated indirectly by incorporating a separate radiation absorber, such as carbon black, into the dye layer. However, carbon black has a tendency to aggregate or agglomerate when coated so that the absorber is not uniformly distributed in the donor element. In addition, small carbon black particles tend to be carried over with the dye, contaminating the image.

Alternatively, an infra-red absorbing compound can be added to the dye layer. Dye donor layers containing infra-red absorbing materials have been disclosed by, for example, Barlow, U.S. Pat. No. 4,778,128, which discloses thermal printing media comprising infra-red absorbing poly(substituted)phthalocyanine compounds; DeBoer, EPO Application 0 321 923, which discloses infra-red absorbing donor elements which contain cyanine dyes; and DeBoer, U.S. Pat. No. 4,942,141, which discloses infra-red absorbing donor elements which contain selected squarylium dyes. However, there is a continuing need for infra-red absorbing materials which may be used to advantage in laser-induced thermal transfer processes.

SUMMARY OF THE INVENTION

This invention is a done element for a laser-induced thermal transfer process, said donor element comprising a support bearing thereon a colorant layer, said colorant layer comprising a colorant and an infra-red absorbing material, said infra-red absorbing material having the structure:

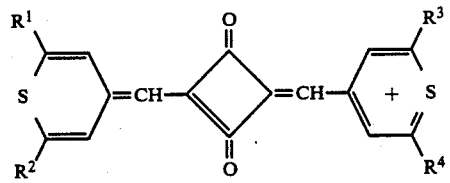

wherein each $R^1$, $R^2$, $R^3$, and $R^4$ is independently an alkyl group of from one to eight carbon atoms.

In a preferred embodiment of this invention, the colorant layer also comprises a binder. In a more preferred embodiment of this invention, $R^1$, $R^2$, $R^3$, and $R^4$ are each t-butyl.

DETAILED DESCRIPTION OF THE INVENTION

The invention is a donor element for thermal transfer processes particularly adapted for use in laser-induced thermal transfer imaging. The donor element comprises a colorant layer and a support.

Colorant Layer

The colorant layer comprises a heat-transferable colorant, an infra-red absorbing material, and, preferably, a binder.

The infra-red absorbing material must have a strong absorption in the emission region of the exciting laser and should have good thermal stability so that it is not decomposed by the incident radiation. The material is preferably substantially non-transferable so it is not transferred during imaging. It is preferred that it be essentially non-absorbing in the visible so that small amounts, if transferred, will not affect the image. It is also preferred that the material be soluble in a solvent which can be used to coat the colorant layer onto the support.

Infra-red absorbing materials of the following structure are used in the colorant layer of the instant invention:

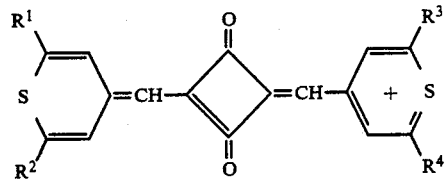

$R^1$, $R^2$, $R^3$, and $R^4$ are each independently alkyl groups of from one to eight carbon atoms. It is preferred that $R^1$, $R^2$, $R^3$, and $R^4$ be the same.

The most preferred infra-red absorbing material is SQS, in which $R^1$, $R^2$, $R^3$, and $R^4$ are each equal to t-butyl. SQS is readily soluble in the usual non-reactive organic solvents, such as, for example, alcohols, ketones, acetonitrile, chlorinated hydrocarbons, such as dichloromethane, and hydrocarbons, such as toluene. It has strong absorption in the infra-red and little or no absorption in the visible. The absorption maximum, 814 nm (measured in dichloromethane) coincides with the wavelength of emission of readily available infra-red diode lasers (750 to 870 nm).

The infra-red absorbing materials may be prepared by conventional synthetic methods. A procedure for the synthesis of SQS is given in Gravesteijn, U.S. Pat. No. 4,508,811, the disclosure of which is incorporated by reference.

The infra-red absorbing materials may be present in the donor layer in any concentration which is effective for the intended purpose. In general, concentrations of 0.1 to 10% of the total coating weight have been found to be effective. A preferred concentration is 1 to 5% of the total coating weight.

The colorant layer comprises a heat-transferable colorant or a mixture of heat-transferable colorants. A heat-transferrable colorant is a colorant, such as, for example, a dye or a pigment, which is transferred from the donor element to the receptor sheet by the action of heat. On transfer it produces the desired color on the receptor sheet. Important criteria for the selection of a heat-transferable colorant are its thermal properties, brightness of shade, light and heat fastness, and facility of application to the support. For suitable performance, the colorant should transfer evenly, in a predetermined relationship to the heat applied, so that the intensity of color on the receptor sheet is smoothly related to the heat applied and good density gradation is attained. The colorant must be migrate from the donor element to the receiver sheet at the imaging energies employed, generally 0.2 to 2 J/cm$^2$.

Useful heat-transferable colorants include: (a) pigments dispersed in polymeric matrices which will soften or melt on heating, and (b) dyes, such as, for example, sublimable dyes. Useful sublimable dyes, available from Crompton and Knowles (Reading, Pa.), include: Intratherm ® Dark Brown (azo type, Disperse Brown 27), Intratherm ® Pink 1335NT (anthraquinone type); Intratherm ® Brilliant Red P-1314NT (anthraquinone type, Disperse Red 60); Intratherm ® Red P-1339 (anthraquinone type Disperse Violet 17); Intratherm ® Blue P-1305NT (anthraquinone type, Disperse Blue 359); and Intratherm ® Yellow 343NT (quinoline type, Disperse Yellow 54). Representative sublimable dyes are disclosed in: Gregory, U.S. Pat. Nos. 4,764,178; Hotta, 4,541,830; Moore, 4,698,651; Evans, 4,695,287; Weaver, 4,701,439; DeBoer, 4,772,582; and DeBoer, 4,942,141.

The heat-transferable colorant and infra-red absorbing material are preferably dispersed in a polymeric binder. Typical binders include, but are not limited to: cellulose derivatives, such as, cellulose acetate, cellulose triacetate, cellulose acetate butyrate, cellulose acetate propionate, cellulose acetate hydrogen phthalate; polyacetals, such as polyvinyl butyral; waxes having a softening or melting point of about 60° C. to about 150° C.; acrylate and methacrylate polymers and copolymers; polycarbonate; copolymers of styrene and acrylonitrile; polysulfones; and poly(phenylene oxide). The binder may be used at a coating weight of about 0.1 to about 5 g/m$^2$.

It will be recognized that the infra-red absorbing material and the heat-transferable colorant may be present in separate layers on the support. Such an arrangements is considered to be equivalent to that described herein.

Support

Any material which is dimensionally stable, capable of transmitting the radiation from the infra-red laser to the colorant layer, and not adversely affected by this radiation can be used as the support. Such materials include, but are not limited to: polyesters, such as, for example, polyethylene terephthalate; polyamides; polycarbonates; glassine paper; cellulose esters; fluoropolymers; polyethers; polyacetals; polyolefins; etc. A preferred support material is polyethylene terephthalate film. The support typically has a thickness of from about 2 to about 250 microns and may comprise a subbing layer, if desired. A preferred thickness is about 10 microns to about 75 microns.

Although the colorant layer can be applied to the support as a dispersion in a suitable solvent, application from solution is preferred. Any suitable solvent may be used to coat the colorant layer. The colorant layer may be coated onto the support using conventional coating techniques or it may be printed thereon by a printing technique, such as, for example, gravure printing.

Receptor Sheet

The receptor sheet typically comprises a support and an image-receiving layer. The support is comprised of a dimensionally stable sheet material. It may be a transparent film, such as, for example, polyethylene terephthalate, polyether sulfone, a polyimide, a poly(vinyl alcohol-co-acetal), or a cellulose ester, such as for example, cellulose acetate. The support may also be opaque, such as, for example, polyethylene terephthalate filled with a white pigment such as titanium dioxide, ivory paper, or synthetic paper, such as Tyvek ® spunbonded olefin.

The image receiving layer may comprise a coating of, for example, a polycarbonate, a polyurethane, a polyester, polyvinyl chloride, styrene/acrylonitrile copolymer, poly(caprolactone), and mixtures thereof. The image receiving layer may be present in any amount which is effective for the intended purpose. In general, good results have been obtained at coating weights of 1 to 5 g/m$^2$.

Colorant Transfer

The donor elements are used to form a colored image by thermal colorant transfer. This process comprises imagewise exposure of the donor element with an infra-red laser so that colorant is transferred to the receptor sheet to form a colored image.

The donor element may be used in sheet form or in the form of a continuous roll or ribbon. The donor element may comprise a single color or it may comprise alternating areas of different colors, such as, for example, cyan, magenta, yellow, and black.

Although various types of lasers may be used to effect transfer of the heat-transferable colorant from the donor element to the receiver sheet, diode lasers emitting in the region of 750 to 870 nm offer substantial advantage in terms of their small size, low cost, stability, reliability, ruggedness, and ease of modulation. Diode lasers emitting in the range of 800 to 830 nm are preferred for use with the donor elements of this invention. Such lasers are commercially available from, for example, Spectra Diode Laboratories (San Jose, Calif.).

A transfer assemblage comprises a donor element and a receiver sheet in which the colorant layer of the donor element is contiguous to the image receiving layer of the receiver sheet. This assemblage may be preassembled as an integral unit when a single colored image is desired. This may be done by reversibly adhering the donor element and the receiver sheet together at their margins. After imagewise exposure, the they are separated to reveal the image on the receiver sheet.

When a multicolor image is to be produced, the assemblage is formed a plurality of times. After the first colored image is transferred, the assemblage is separated and a second donor element (or another area of the same donor element which comprises a differently colored heat-transferable colorant) is brought in contact with the receiver sheet and imagewise exposed in register with the first image. The process is repeated with donor elements containing differently colored heat-transferable colorants as many times as desired. A preferred process consists of transferring cyan, yellow, and magenta images to produce a three colored image.

The donor element of this invention is adapted for the production of both single color and multicolor colored images by a laser-induced thermal transfer process. It can be used to obtain prints of images which have been recorded electronically by various electronic devices, such as color video cameras. It can also be used to generate hard copy output in various proofing applications.

The advantageous properties of this invention can be observed by reference to the following examples which illustrate, but do not limit, the invention.

EXAMPLES

Glossary

Butvar® B-90 Polyvinyl butyral; CAS 63148-65-2; Monsanto, St. Louis, Mo.

CAB Cellulose acetate butyrate (17% butyl); Aldrich, Milwaukee, Wis.

Joncryl® 682 Solid acrylic resin; molecular weight 1,700, acid number 235; Johnson Wax, Racine, Wis.

Lexane® 1500 Polycarbonate; General Electric Co., Pittsfield, Mass.

Lithol Rubine Yellow shade Lithol Rubine flushed in Polyversyl multipurpose vehicle; 50% pigment, 50% vehicle, 83% solids; C.I. 15850:1; Sun Chemical Corp., Cincinnati, Ohio Red P-1339 Intratherm® Red P-1339; C.I. Disperse Violet 17; 1-amino-2-bromo-4-hydroxyanthraquinone; CAS 12217-92-4; Crompton & Knowles Corp., Reading, Pa.

SQS 4-[[3-[[2,6-Bis(1,10dimethylethyl)-4H-thiopyran-4-ylidene]methyl]-2-hydroxy-4-oxo-2-cyclobuten-1-ylidene]methyl-2,6-bis(1,1-dimethylethyl)thiopyrlium hydroxide, inner salt; CAS 88878-49-3

Vybar 260 Polymerized alpha-alkenes of greater the ten carbon atoms; Petrolite Specialty Polymer Group, Tulsa, Okla.

WB-17 Petrolite WB-17: Oxidized greater than C10 alpha-alkene reaction product with ethanolamine and 2,4-toluene diisocyanate; Petrolite Specialty Polymers Group, Tulsa, Okla.

In the examples which follow, "coating solution" refers to the mixture of solvent and additives which is coated on the support, even though some of the additives may be in suspension rather than in solution. Amounts are expressed in parts by weight.

EXAMPLE 1

A coating solution containing the following ingredients, expressed in parts by weight, was made up: Red P-1339, 0.188; CAB, 0.188; SQS, 0.0075; and dichloromethane, 9.62. The composition was stirred to completely dissolve the solids and coated on corona discharge treated 3 mil (about 75 micron) polyethylene terephthalate film with a doctor knife an about 2 mil (about 50 micron) wet gap and air dried to form the donor element within a coating thickness of about 0.55 micron.

The coated side of the donor element was contacted with a receptor sheet of Thermacolor® video print paper (Eastman Kodak Company, Rochester, N.Y.) by tightly taping them together on a test drum to form a thermal transfer assemblage. The uncoated side of the donor element was exposed on a rotating drum with a 100 mW infra-red laser emitting at 830 nm (Spectra Diode Laboratories, Inc., San Jose, Calif.). At 0.33 J/cm$^2$, very intense magenta lines about 8 micron wide were obtained on the receptor sheet.

EXAMPLE 2

A coating solution containing the following ingredients, was made up: Red P-1339, 0.188; Lexan® 1500, 0.188; SQS, 0.0075; and dichloromethane, 9.62. The composition was dissolved, coated, and imaged as in Example 1. At 0.33 J/cm$^2$, very intense magenta lines about 8 micron wide were obtained on the receptor sheet.

EXAMPLE 3

A coating solution containing the following ingredients, was made up: Red P-1339, 0.75; Butvar® 90, 0.75; SQS, 0.06; and dichloromethane, 18.44. The composition was dissolved, coated, and imaged as in Example 1. At 0.33 J/cm$^2$, very intense magenta lines about 8 micron wide were obtained on the receptor sheet.

CONTROL EXAMPLE A

A coating solution containing the following ingredients, was made up: Red P-1339, 0.75; Butvar® B-90, 0.75; dichloromethane, 18.5. The composition was dissolved, coated, and imaged as in Example 1. No image could be detected on the receptor sheet.

EXAMPLE 4

To form the donor element, a coating solution containing the following ingredients, was made up: Lithol Rubine, 1.38; WB-17, 1.10; SQS, 0.12; and toluene, 27.52. WB-17 was predissolved in toluene with slight heating. Then the ingredients were dispersed on a 2-roll mill overnight. The dispersion was coated on corona discharge treated polyethylene terephthalate using a doctor knife with an about 2 mil (about 50 microns) wet gap.

After drying, the donor element was contacted with a sheet of the Thermacolor® video print paper (Eastman Kodak Co., Rochester, N.Y.) or a sheet of the Tektronix thermal transfer paper (Tektronix Co., Wilsonville, Oreg.) as described in Example 1. The thermal transfer assemblage was imaged as described in Example 1. At 0.38 J/cm$^2$, very intense bright red, 8 micron lines were obtained on the receptor sheet (about 100% transfer) with very little background stain.

CONTROL EXAMPLE B

A coating solution containing the following ingredients, was made up: Lithol Rubine, 1.38; WB-17, 1.10; and toluene, 27.52. The dispersion was prepared, coated, and imaged as in Example 4. No transfer of colorant to the receptor sheet was be observed.

EXAMPLE b 5

A coating solution containing the following ingredients, was made up: Lithol Rubine, 1.66; Vybar 260, 0.50; SQS, 0.04; and toluene, 17.80. Vybar 260 was predissolved in toluene with slight heating. The composition was dispersed, coated, and imaged as in Example 4. At 0.75 J/cm$^2$, very intense red lines were obtained on the receptor sheet. A control with no SQS showed no image.

EXAMPLE 6

A coating solution containing the following ingredients, was made up: Lithol Rubine, 0.66; Joncryl® 682, 0.50; SQS, 0.03; and tetrahydrofuran, 11.81. The composition was dispersed, and coated on both corona discharge treated polyethylene terephthalate film and plain polyethylene terephthalate film. Both coatings were imaged as in Example 4 to give very intense red lines on the receptor sheet at 0.75 J/cm$^2$.

What is claimed is:

1. A donor element for a laser-induced thermal transfer process, said donor element comprising a support bearing thereon a colorant layer, said colorant layer comprising a colorant and an infra-red absorbing material said infra-red absorbing material having the structure:

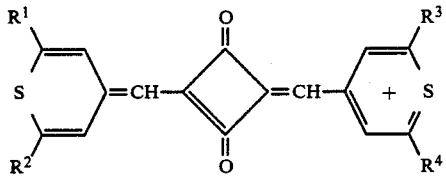

wherein each of $R^1$, $R^2$, $R^3$, and $R^4$ is independently an alkyl group of from one to eight carbon atoms.

2. The donor element of claim 1 wherein $R^1$, $R^2$, $R^3$, and $R^4$ are the same.

3. The donor element of claim 1 wherein $R^1$, $R^2$, $R^3$, and $R^4$ are each t-butyl.

4. The donor element of claim 1 wherein the colorant is a sublimable dye.

5. The donor element of claim 1 wherein the colorant is a pigment.

6. The donor element of claim 1 wherein the colorant layer additionally comprises a binder.

7. The donor element of claim 6 wherein $R^1$, $R^2$, $R^3$, and $R^4$ are the same.

8. The donor element of claim 6 wherein $R^1$, $R^2$, $R^3$, and $R^4$ are each t-butyl.

9. The donor element of claim 6 wherein the colorant is a pigment.

10. The donor element of claim 9 wherein $R^1$, $R^2$, $R^3$, and $R^4$ are the same.

11. The donor element of claim 9 wherein $R^1$, $R^2$, $R^3$, and $R^4$ are each t-butyl.

12. The donor element of claim 6 wherein the colorant is a sublimable dye.

13. The donor element of claim 12 wherein $R^1$, $R^2$, $R^4$, and $R^4$ are the same.

14. The donor element of claim 12 wherein $R^1$, $R^2$, $R^3$, and $R^4$ are each t-butyl.

15. A thermal transfer assemblage for a laser-induced thermal transfer process, said thermal transfer assemblage comprising:

(a) a donor element comprising a support bearing thereon a colorant layer, said colorant layer comprising a colorant and an infra-red absorbing material, said infra-red absorbing material having the structure:

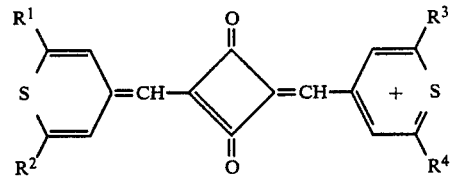

wherein each of $R^1$, $R^2$, $R^3$, and $R^4$ is independently an alkyl group of from one to eight carbon atoms; and (b) a receiver sheet comprising support and an image-receiving layer; wherein said colorant layer of said donor element is contiguous to said image receiving layer of said receiver sheet.

16. The thermal transfer assemblage of claim 15 wherein $R^1$, $R^2$, $R^3$, and $R^4$ are the same.

17. The thermal transfer assemblage of claim 15 wherein $R^1$, $R^2$, $R^3$, and $R^4$ are each t-butyl.

18. The thermal transfer assemblage of claim 15 wherein the colorant is a sublimable dye.

19. The thermal transfer assemblage of claim 15 wherein the colorant is a pigment.

20. The thermal transfer assemblage of claim 15 wherein the colorant layer additionally comprises a binder.

21. The thermal transfer assemblage of claim 20 wherein colorant is a pigment.

22. The thermal transfer assemblage of claim 21 wherein $R^1$, $R^2$, $R^3$, and $R^4$ are the same.

23. The thermal transfer assemblage of claim 21 wherein $R^1$, $R^2$, $R^3$, and $R^4$ are each t-butyl.

24. The thermal transfer assemblage of claim 20 wherein $R^1$, $R^2$, $R^3$, and $R^4$ are the same.

25. The thermal transfer assemblage of claim 20 wherein $R^1$, $R^2$, $R^3$, and $R^4$ are each t-butyl.

26. The thermal transfer assemblage of claim 20 wherein the colorant is a sublimable dye.

27. The thermal transfer assemblage of claim 26 wherein $R^1$, $R^2$, $R^3$, and $R^4$ are the same.

28. The thermal transfer assemblage of claim 26 wherein $R^1$, $R^2$, $R^3$, and $R^4$ are each t-butyl.

* * * * *